United States Patent [19]

Geithman

[11] Patent Number: 4,646,967

[45] Date of Patent: Mar. 3, 1987

[54] ULTRASONIC WATER JET HAVING ELECTROMAGNETIC INTERFERENCE SHIELDING

[75] Inventor: Glenn A. Geithman, Renton, Wash.

[73] Assignee: The Boeing Company, Seattle, Wash.

[21] Appl. No.: 789,254

[22] Filed: Oct. 18, 1985

Related U.S. Application Data

[63] Continuation of Ser. No. 602,997, Apr. 23, 1984, abandoned, which is a continuation-in-part of Ser. No. 388,850, Jun. 16, 1982, abandoned.

[51] Int. Cl.[4] ..... B05B 17/06; B05B 3/14

[52] U.S. Cl. ..... 239/4; 239/102.2; 310/317

[58] Field of Search ..... 239/4, 102; 310/317

[56] References Cited

U.S. PATENT DOCUMENTS

| | | | |
|---|---|---|---|
| 3,980,906 | 9/1976 | Kuris et al. | 310/317 X |
| 4,004,736 | 1/1977 | George | 239/4 X |
| 4,109,863 | 8/1978 | Olson et al. | 239/102 |
| 4,307,838 | 12/1981 | Martin | 239/102 |
| 4,319,155 | 3/1982 | Nakai et al. | 239/102 X |
| 4,326,553 | 4/1982 | Hall | 239/102 X |

OTHER PUBLICATIONS

Lynnworth *Ultrasonic Impedance Matching from Solids to Gases*10/22/64, pp. 37–47.

*Primary Examiner*—Joseph F. Peters, Jr.
*Assistant Examiner*—Mary Beth O. Jones
*Attorney, Agent, or Firm*—Conrad O. Gardner; B. A. Donahue

[57] ABSTRACT

An ultrasonic water jet having first and second housing members. The first housing member includes an interior exponentially shaped duct and a plurality of water inlets equiangularly displaced and circumferentially disposed about the central axis of the exponentially shaped duct for cleansing a face of the quarter wave matching plate which is bonded to a ceramic disk transducer which forms part of a hermetically sealed assembly. This transducer assembly is both water tight and electromagnetically shielded.

6 Claims, 8 Drawing Figures

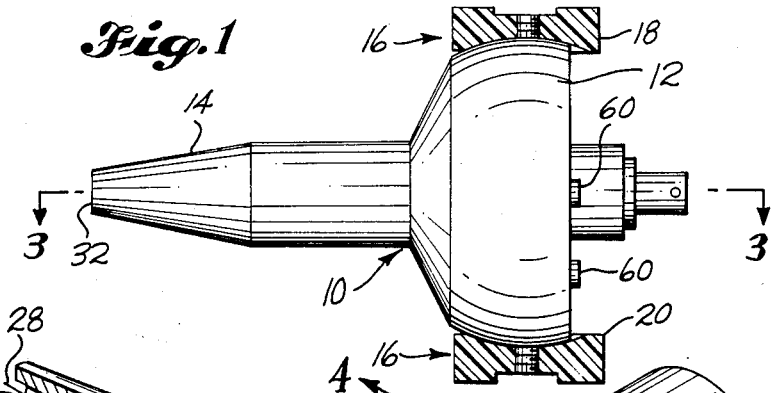
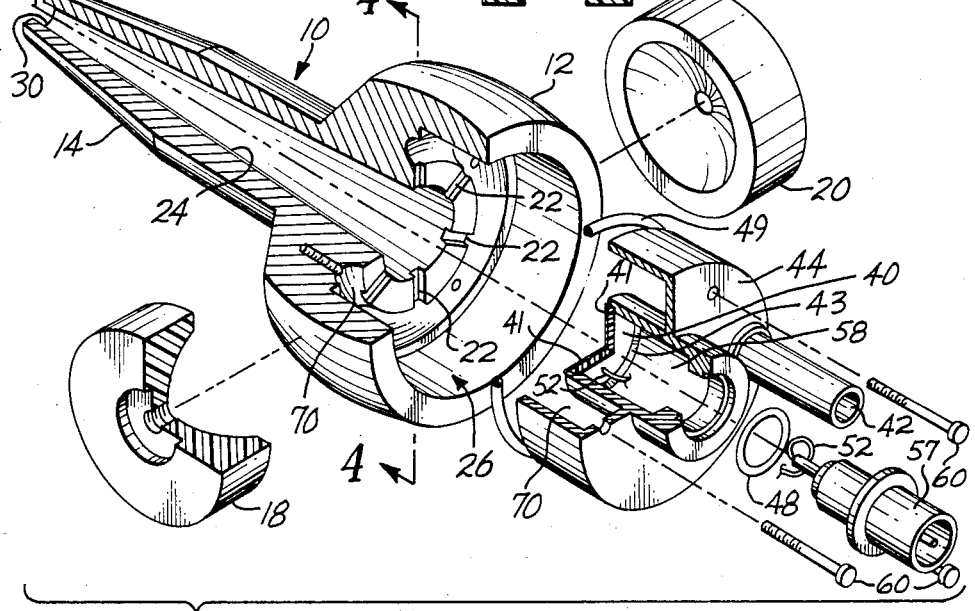
Fig. 2
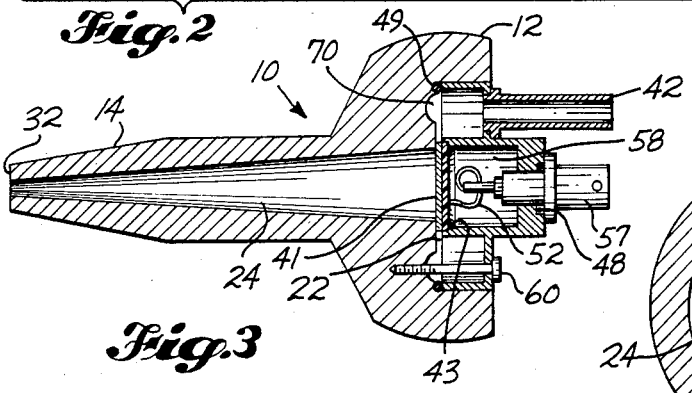
Fig. 3
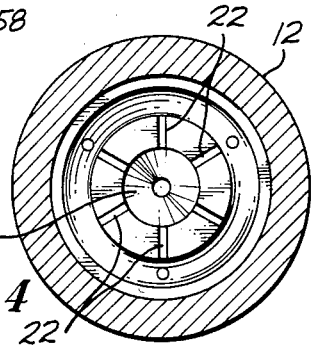
Fig. 4

ULTRASONIC WATER JET HAVING ELECTROMAGNETIC INTERFERENCE SHIELDING

This application is a continuation of now abandoned U.S. patent application Ser. No. 602,997, filed Apr. 23, 1984 which is a continuation-in-part of now abandoned U.S. patent application Ser. No. 388,850, filed June 16, 1982 and assigned to The Boeing Company, and relates to water jets for ultrasonic inspection and more particularly to an ultrasonic water jet having a two-section transducer mounting housing such as shown in U.S. Pat. No. 4,004,736, issued Jan. 25, 1977 and assigned to The Boeing Company.

Prior art devices, e.g. as exemplified by U.S. Pat. No. 2,512,743 show jet spraying devices having transducer elements and an exponential duct.

German Pat. No. 710,654 is illustrative of water inlet means for angularly directing a flow of liquid to be atomized onto the face of a resonating atomizing plate, while U.S. Pat. No. 3,804,329 shows circumferential application of a plurality of water streams to the surface of a resonating plate. Also, U.S. Pat. No. 3,932,109 shows an ultrasonic burner having ultrasonic atomizing means which atomizes a liquid axially into an ejection passage.

Ultrasonic impedance matching of piezoelectric transducers has been shown in the prior art literature, see e.g. Lynnworth: *Ultrasonic Impedance Matching from Solids to Gases,* I.E.E.E. Transactions on Sonics and Ultrasonics, June 1965, pages 37–48.

It is accordingly an object of this invention to provide means including a two-piece housing for forming a plenum chamber for water input and further mounting a disk type transducer element, together with a quarter wave impedance matching plate, in line with an exponentially shaped nozzle duct in a manner providing for circumferential directions of a plurality of streams of water from the plenum chamber against a major surface area of the quarter wave matching plate to reduce water swirling and bubble formation at the aforementioned major surface.

It is a further object of this invention to provide means for generating a coherent water stream capable of propagating ultrasonic energy thereby minimizing ultrasonic energy loss due to stream break up.

It is yet another object of this invention to provide means including a hermetically sealed and electromagnetically shielded transducer assembly incorporating a quarter wave matching plate across the inlet of an exponentially shaped nozzle duct of slightly lesser diameter than the face diameter of the disk shaped transducer thereby maximizing sound flow in the fluid transmitted through the exponentially shaped nozzle duct.

The foregoing and other objects and advantages of this invention will best be understood by the following detailed description of an embodiment thereof taken in view of the accompanying drawings, wherein:

FIG. 1 is a side view including mounting assembly illustrative of a preferred embodiment of the integrated ultrasonic water jet;

FIG. 2 is an exploded perspective view of the ultrasonic water jet of FIG. 1 showing interrelationship of parts for assembly;

FIG. 3 is a side view in section detailing water flowing from inlet to outlet through plenum, circumferentially disposed radially extending water inlets against one side of a disk type quarter wave impedance matching plate, together with a piezoelectric transducer element and through an exponentially shaped duct;

FIG. 4 is a cross-sectional view taken in the direction of the line 4—4 of FIG. 2 showing in more detail the radially extending water inlets disposed as slots in the inner surface of the first housing member which extend from the plenum chamber into the wall of the exponentially shaped inner duct;

Figure 5:
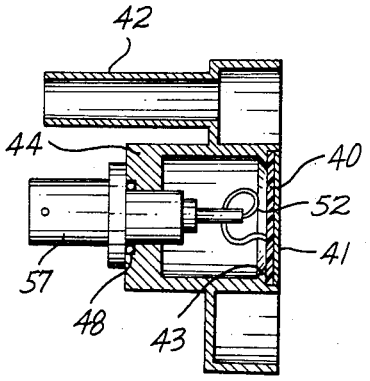
FIG. 5 is a side view of the transducer assembly detailing the mounting of a disk shaped ceramic transducer and a quarter wave impedance matching plate in a hermetically sealed and electromagnetically shielded stainless steel housing.
Figure 6:
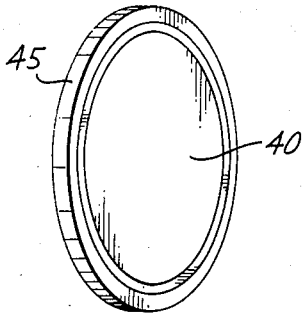
FIG. 6 is a view of the ceramic piezoelectric transducer element depicting the coaxial gold coating.

Referring now in detail to the drawings, especially to FIG. 1 thereof, a first one-piece housing section 10 molded from plastic having a ball shaped end portion 12 formed at one end of the section 10 and a nozzle shaped end portion 14 formed at the other end thereof. Ball shaped end portion 12 is supported by a socket type mounting assembly 16 comprising a pair of clamping members 18 and 20 having concave inner surfaces with radii of curvature equal to the radius curvature of ball shaped end portion 12. Mounting assembly 16 permits ball joint mounting and support of first housing section 10 above a table (not shown) to accommodate the parts desired to be inspected while allowing rotating of nozzle shaped end portion 14 for scanning of parts.

Turning now to FIG. 2, it will be noted that ball shaped end portion 12 has an inner cylindrically shaped volume 26 through which water is coupled via a plurality (e.g. six) of radially extending slots 22 formed in the bottom portion of volume 26 of plastic section 10 into exponentially shaped duct 24. Duct 24 is of circular cross section and coaxially disposed about the central axis 28 of section 10 and extends through nozzle shaped end portion 14 to outlet 30 which corresponds to the ending diameter of duct 24. Nozzle shaped end portion 14 has a terminating end surface 32 (as seen in FIGS. 1 and 3) extending along a plane disposed at right angles to the water flow axis (central axis 28). Sharp termination of nozzle shaped end portion 14 by a planar surface in the aforementioned manner at 90° to the water flow axis 28 provides the least turbulent jet stream when compared to other geometrically shaped terminations of exponentially shaped duct 24.

Exponential duct 24 is provided with a shape in accordance with the following formula:

$$D_1 D_0 = BL$$

where:

$D_1$ = ending diameter at outlet 30;

$D_0$ = starting diameter at the bottom of inner cylindrically shaped volume 26;

B = taper constant; and

L = length between the aforementioned starting and ending diameters.

With a piezoelectric transducer 40, together with quarter wave matching plate 41 of diameter of 0.750 inch positioned across the inlet or starting diameter of duct 24 of 0.690 inch, maximizing of sound flow is then transmitted through exponentially shaped nozzle duct 24. With this minimum of overlap provided by a difference in diameters of 0.060 inch or less, suitable mounting and maximum exposure of transducer 40 is provided. The ending diameter of duct 24 forming outlet 30 should be in the range of $\frac{1}{8}$ inch to $\frac{1}{2}$ inch where water pressure to input duct 42 of the ultrasonic water jet is between 1.6 and 3 psi. Within the above operating parameters, a 4 to 6 inch stiff stream is provided from outlet 30 during operation of the present ultrasonic water jet device. It should be noted that input duct 42 is formed by threading a small section of stainless steel ducting to an aperture on semicylindrically shaped second housing member 44, also formed of stainless steel. A ceramic piezoelectric element 40 is bonded by means of electrically conductive epoxy 43 to the semicylindrically shaped second member 44. This provides an electrical ground as well as a mechanical connection between the semicylindrically shaped second member 44 and outer gold plated coaxial surface 45 of the ceramic piezoelectric element 40. This results in the combination of the outer coaxial gold plating 45, together with semicylindrically shaped second member 44 forming a very effective electromagnetic shield which is insulated from ground by means of the electrically non-conductive plastic nozzle housing section 10. This is of particular importance when extremely high signal amplification is used in a multichannel system and where it is desirable to minimize electrical interference or cross talk between adjacent receive channels. It should be noted that piezoelectric transducer 40 has a first terminal lead wire 52 (electrically insulated) which passes through a channel 58 (see FIG. 3) and is connected to the center terminal of a waterproof BNC connector 57, together with an "O" ring seal 48 (see FIG. 5). A quarter wave impedance matching plate 41, FIG. 5, is bonded both to the surface of the ceramic piezoelectric element 40 and to the semicylindrically shaped second member 44. This matching plate 41 is fabricated by mixing powdered tungsten with epoxy resin. The ratio of the tungsten to epoxy resin is experimentally determined, consistent with the requirement that the acoustic impedance of the matching plate 41 is equal to the geometric mean between the acoustic impedance of the ceramic element 40 and the acoustic impedance of water.

$$Z_M = \sqrt{Z_T Z_W}$$

where:

$Z_M$=acoustic impedance of the matching plate;

$Z_T$=acoustic impedance of the transducer element; and $Z_W$=acoustic impedance of water.

Figure 7:
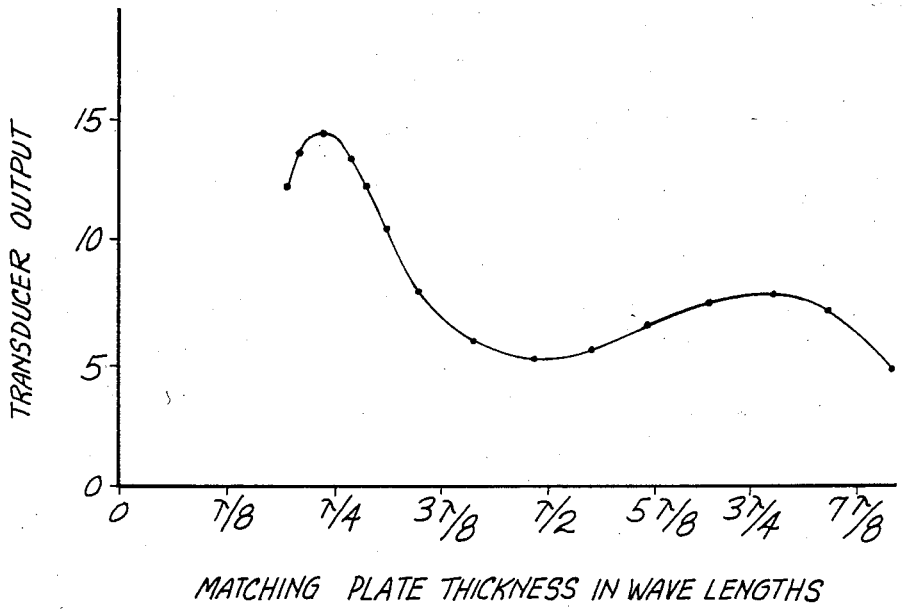
FIG. 7 illustrates experimentally how the relative output of the transducer varies as a function of the thickness of the impedance matching plate; and, FIG. 8 is a circuit schematic shown in block diagram illustrative of an ultrasonic generator, viz. a pulsed oscillator for coupling tone burst energy to the ceramic piezoelectric transducer element of FIG. 6.

After the epoxy/tungsten combination is bonded to the surface of the ceramic element 40, it is machined to the desired quarter wave thickness 41. FIG. 7 illustrates how the relative output of the transducer varies as a function of matching plate thickness. The relative maxima occur at odd multiples of quarter wavelength thicknesses of matching plate material. This is a result of the constructive interference effects which occur at these values. The ($3\lambda/4$) peak is less pronounced because the matching plate material is somewhat lossy to ultrasonic energy. The use of the matching plate serves two purposes. First, the greatest amount of ultrasonic energy is coupled to the water. This is very important because some of the new advanced composite structures used on modern aircraft are highly attenuating to ultrasonic energy. Secondly, the bonding of the matching plate 41 to the second member 44 results in a waterproof seal, greatly increasing the reliability of the assembly over previous design, e.g. as shown in U.S. Pat. No. 4,004,736 hereinbefore referenced.

Figure 8:
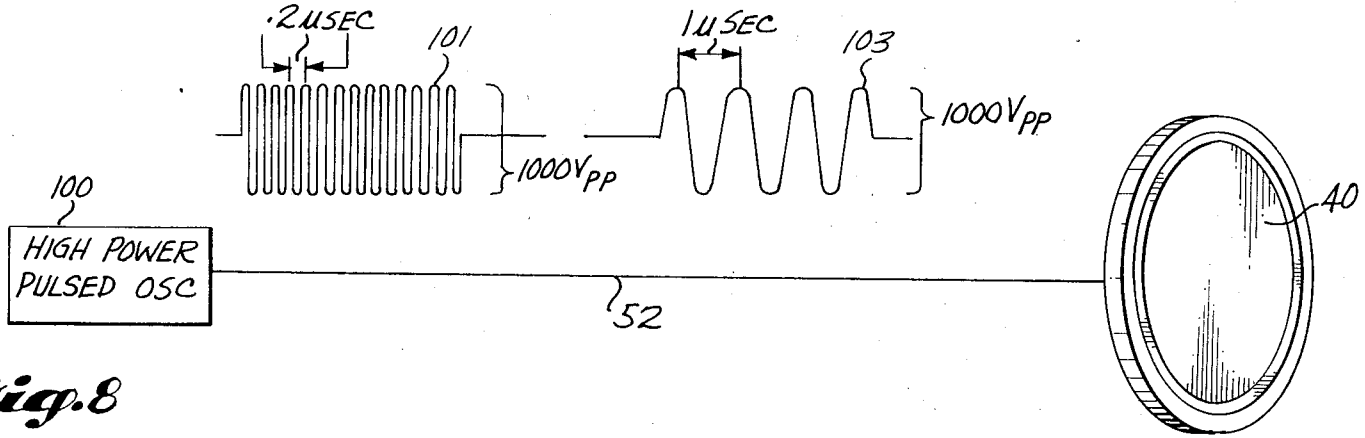

Suitable ultrasonic energy from an ultrasonic generator 100 as seen in FIG. 8 is then coupled to cause piezoelectric transducer 40 to vibrate at an ultrasonic frequency in a manner readily understood by those skilled in the art. The ultrasonic generator 100 in the present preferred embodiment, however, comprises a tone burst oscillator providing approximately 5 cycles of the frequency required to excite piezoelectric transducer element 40. A particular advantage of transducer excitation as shown in FIG. 8 is that it will work almost as well at odd harmonics as it does at the fundamental resonant frequency where the matching plate thickness 41, as seen in the transducer assembly of FIG. 5, is given by:

$$T=n(\lambda/4)$$

wherein n is a constant equal to either the fundamental frequency of the piezoelectric transducer when n=1, or odd harmonic frequencies thereof when n=an odd integer greater than one;

where:

T=thickness of matching plate 41; and $\lambda$=wave length of sound in the matching plate material.

This means that a 1 $MH_z$ transducer should work on 3, 5, 7 $MH_z$, etc. This was discovered and this effect is being tested at present in an experimental laboratory system for future ultrasonic scanner utilization. Future systems will not necessitate a change in nozzle assemblies in order to switch from 1 $MH_z$ to 5 $MH_z$. All that is required is a change in the frequency of the excitation tone burst to the transmit transducer and then application to lead 52 as seen in FIG. 8.

The advantage of going to a higher frequency such at the 5 $MH_z$ tone burst 101 is greater defect sensitivity because higher frequencies are more strongly attenuated by composite materials than a lower frequency, e.g., the 1 $MH_z$ tone burst 103. The trade-off is that higher frequencies will not penetrate the thicker composite structures such as honeycomb. The embodiment of FIG. 8 facilitates the selection of the appropriate frequency by selection of appropriate switching thereof rather than the time consuming changing of transducer and nozzle types of hardware.

Upon assembly, as shown in FIG. 3, of electrically conducting second housing member 44 into the volume 26 of non-electrically conducting (plastic) first housing member 10, O-ring 49 is compressed as screws 60 are tightened thereby providing a watertight seal. It should be noted also that the present ultrasonic water jet, when in an assembled condition as shown in FIG. 3, provides water flow from a source (not shown) coupled to input duct 42 into a generally torroidally shaped plenum chamber 70, then through a plurality of radially extending slots 22 into exponentially shaped duct 24 by way of the major surface of disk 40 facing duct 24 inlet, and via outlet 30 in the form of hereinbefore mentioned 4 to 6 inch stiff stream (stiff meaning generally unbroken and free of bubbles).

What is claimed is:

1. In combination an apparatus providing through transmission water jet coupling for ultrasonic scanning:

a first non-electrically conductive housing section having an interior exponentially shaped duct;

a second electrically conductive housing section;

a disk shaped piezoelectric transducer concentrically disposed about the central axis of said exponentially shaped duct and within said second electrically conductive housing section;

a matching plate disposed across the inlet of said interior exponentially shaped duct and between said first non-electrically conductive housing section and said disk shaped piezoelectric transducer;

said matching plate having a thickness $T=n\lambda/4)$ where n is a constant equal to either the fundamental frequency of said disk-shaped piezoelectric transducer when $n=1$, or odd harmonic frequencies thereof when n=an odd interger greater than one, and $\lambda$=wavelength of sound in said matching plate; and, a tone burst oscillator coupled to said disk shaped piezoelectric transducer for providing about 5 cycles of tone burst energy at the excitation frequency of said disk shaped piezoelectric transducer.

2. The invention according to claim 1 wherein said tone burst energy has a frequency of about 1 $MH_z$.

3. The invention according to claim 1 wherein said tone burst energy has a frequency of about 5 $MH_z$.

4. A method comprising the steps of:

providing an apparatus having through transmission water jet coupling for ultrasonic scanning which includes:

a first non-electrically conductive housing section having an interior exponentially shaped duct;

a second electrically conductive housing section;

a disk shaped piezoelectric transducer concentrically disposed about the central axis of said exponentially shaped duct and within said second electrically conductive housing section;

a matching plate disposed across the inlet of said interior exponentially shaped duct and between said first non-electrically conductive housing section and said disk shaped piezoelectric transducer;

said matching plate having a thickness $T=n(\lambda/4)$ where n is a constant equal to either the fundamental frequency of said disk-shaped piezoelectric transducer when $n=1$, or odd harmonic frequencies thereof when n=an odd integer greater than one, and $\lambda$=wavelength of sound in said matching plate; and, then coupling a tone burst oscillator to said disk shaped piezoelectric transducer and further providing with said tone burst oscillator about 5 cycles of tone burst energy at the excitation frequency of said disc shaped piezoelectric transducer.

5. The invention according to claim 4 wherein the step of providing about 5 cycles of tone burst energy comprises providing said tone burst energy at a frequency of about 1 $MH_z$.

6. The invention according to claim 4 wherein the step of providing about 5 cycles of tone burst energy comprises providing said tone burst energy at a frequency of about 5 $MH_z$.

* * * * *